United States Patent [19]

Campbell

[11] Patent Number: 4,730,697

[45] Date of Patent: Mar. 15, 1988

[54] SEAT DEVICE FOR A LADDER

[76] Inventor: John C. Campbell, 11A Cheriton Avenue, Clayhall, Ilford, Essex, England

[21] Appl. No.: 1,387

[22] Filed: Jan. 8, 1987

[30] Foreign Application Priority Data

Jan. 24, 1986 [GB] United Kingdom ..... 8601711
Apr. 4, 1986 [GB] United Kingdom ..... 8608340

[51] Int. Cl.[4] ..... E06C 7/16

[52] U.S. Cl. ..... 182/121; 182/129; 248/238

[58] Field of Search ..... 182/121, 122, 187, 214, 182/129; 248/238

[56] References Cited

U.S. PATENT DOCUMENTS

| | | | |
|---|---|---|---|
| 221,780 | 11/1879 | Clark | 182/121 |
| 271,509 | 1/1883 | Nolton . | |
| 407,079 | 7/1889 | Laskey | 182/121 |
| 812,620 | 2/1906 | Alstine . | |
| 1,090,836 | 3/1914 | Bush | 182/187 |
| 1,104,996 | 7/1914 | McHale | 248/238 |
| 1,307,468 | 6/1919 | Wells | 182/3 |
| 1,921,583 | 8/1933 | Reed | 182/121 |
| 2,553,322 | 5/1951 | Kurmer | 248/238 |
| 2,656,223 | 10/1953 | Gray | 182/121 |
| 2,802,702 | 8/1957 | Rose . | |
| 2,818,310 | 12/1957 | Campbell . | |
| 2,871,067 | 1/1959 | Brogdon . | |
| 3,115,213 | 12/1963 | Cloutier | 182/187 |
| 3,232,664 | 2/1966 | McBride | 182/187 |
| 4,085,819 | 4/1978 | Ohnstad . | |
| 4,211,307 | 7/1980 | Ethridge . | |
| 4,342,374 | 8/1982 | Montana | 182/121 |
| 4,615,412 | 10/1986 | Clarke | 182/121 |

FOREIGN PATENT DOCUMENTS

| | | |
|---|---|---|
| 103446 | 1/1917 | United Kingdom . |
| 116579 | 6/1918 | United Kingdom . |
| 228430 | 2/1925 | United Kingdom . |
| 486459 | 6/1938 | United Kingdom . |
| 659851 | 9/1949 | United Kingdom . |
| 743970 | 1/1956 | United Kingdom . |
| 2135378 | 8/1984 | United Kingdom . |

*Primary Examiner*—Reinaldo P. Machado
*Attorney, Agent, or Firm*—Roylance, Abrams, Berdo & Goodman

[57] ABSTRACT

A seat device for a ladder, which seat device comprises a frame, a first hook device extending from the frame and for fitting over a first rung of the ladder, a second hook device extending from the frame and for fitting over a second and adjacent rung of the ladder, a foldable seat extending from the frame and for enabling a person to sit down while working on the ladder, a support member for supporting the seat in an unfolded position, and releasable locking means for maintaining the seat in its unfolded position and for preventing accidental collapse of the seat to a folded position.

4 Claims, 9 Drawing Figures

SEAT DEVICE FOR A LADDER

This invention relates to a seat device for a ladder.

It is notoriously difficult and uncomfortable to work on a ladder, for example for decorating or renovating the outside of a house. Prolonged periods of standing on a ladder may cause a person's feet and/or their back to ache. In addition, the person must often hold the ladder with one hand so that both of their hands are not free for ease of working.

It is an aim of the present invention to obviate or reduce the above mentioned problem.

Accordingly, this invention provides a seat device for a ladder, which seat device comprises a frame, first hook means extending from the frame and for fitting over a first rung of the ladder, second hook means extending from the frame and for fitting over a second and adjacent rung of the ladder, a seat which extends from the frame and which is foldable upwardly with respect to the frame, a support member having a first end portion which is remote from the seat and which is permanently pivotally mounted to the frame and a second end portion which is operatively connectible to the seat for the purpose of enabling the support member to support the seat and which is separable from the seat for the purpose of allowing the seat to be unfolded, and releaseable locking means between said seat and said second end portion for maintaining the seat in its unfolded position so that the seat cannot collapse to its folded position as a result of being pushed upwardly as a person is climbing the ladder.

It will be appreciated that, once the person is sitting down on the ladder, the person is given considerable confidence whilst remaining quite safe. The person can tuck their legs underneath the seat device and on to a lower rung. The person can have both hands free for building, decorating or renovating devices. The seat device is particularly handy for painting where it may be desirable to hold a pot of paint in one hand and a painting brush in the other hand. The seat device may act like a spirit level so that, when the seat is level, the ladder will be at a correct angle of inclination.

With a foldable seat, the seat device can be folded for ease of carrying and storing.

With a foldable seat, the seat device may include releaseable locking means for maintaining the seat in its folded position.

With a foldable seat, the seat may be supported on a support member which is permanently pivotally mounted to the frame at its end remote from the seat, and which is separable from the seat at its end adjacent the seat when the seat device is to be folded. With such a design, the seat device may include restraining means for maintaining the support member in a fixed position in the folded condition of the seat. The restraining means may be a spring.

In an alternative design in which the seat is foldable, the seat may be supported on a support member which is permanently pivotally connected to the frame at its end remote from the seat, and which is permanently pivotally connected to the seat at its end adjacent the seat, the support member being foldable into two portions when the seat is to be folded.

The support member may be a bar, rod or tube.

If desired, the angle of repose of the seat with respect to the frame may be adjustable, for example to cater for different angles of inclination of the ladder, for example in circumstances where the angle of inclination of the ladder must be steeper or shallower than would otherwise be desired. The angle of repose of the seat may be adjustable by, for example, having a support member which is adjustable in length by, for example, being telescopic or being provided with a series of adjuster holes, one of which can be appropriately selected when the seat is at a desired angle of repose.

The hook means may comprise a pair of hooks for clipping over one rung of the ladder.

Preferably, the hook means comprises two pairs of hooks for clipping over two rungs of the ladder. Usually, the two rungs of the ladder will be adjacent rungs. It will be apparent that when two pairs of hooks are employed, the weight of the person on the ladder is spread over two rungs and this makes for good safety. With modern ladders which are made of an aluminium alloy, the rungs are very securely fixed in position and there is no danger of rungs becoming defective due to rotting or becoming loose in the sides of the ladder, as used to be the case with wooden ladders.

The hook means may alternatively comprise two hooks for clipping one over each of two separate rungs of the ladder.

The hooks will usually be shaped to fit the rungs of the ladders. Thus, the hooks may be curved for round rungs and square for square rungs.

The seat device may include releasable locking means for releasably locking the seat device to the ladder. This provides a degree of increased safety.

The releaseable locking means may be a bolt for screwing under a rung over which the seat device is clipped. Alternatively, the releaseable locking means may be a spring which hangs from the seat device and which clips under a rung of the ladder.

The seat may have a back rest.

The back rest may be fixed or it may be foldable.

The seat device may advantageously include tool receiving means.

The tool receiving means may be permanently fixed to the seat device or it may be a clip-on fixture. A presently preferred tool receiving means is a tray.

The seat device may include collar means for enabling the seat device to slide over the top of the sides of the ladder. In this case however the seat device will only be able to be used at the top rung position of the ladder.

The ladder may be of any desired size, type and design. The ladder may be a single, double or treble extension ladder. In addition to the ladder being the usual sort of aluminium ladder that is used for building and decorating purposes, the ladder may also be in the form of a step ladder.

The seat device may be made of any desired materials. The frame will usually be made of metal such for example as aluminium. The seat may also be made of other metals such for example as pressed steel.

The seat may also be made of any moulded plastics material or of fibre glass. The moulded plastics material and the fibre glass may be such as to give the seat a warmer feel than if a metal is employed. If a metal is employed for the seat, then this may be covered with a plastics material.

The seat is preferably not wider than the ladder. More preferably, the seat is substantially narrower than the width of the ladder. Such narrow seats are comfortable to sit on and they do not cut into the inside of the legs of a person seated on the seat.

Embodiments of the invention will now be described solely by way of example and with reference to the accompanying drawings in which.

Figure 1:
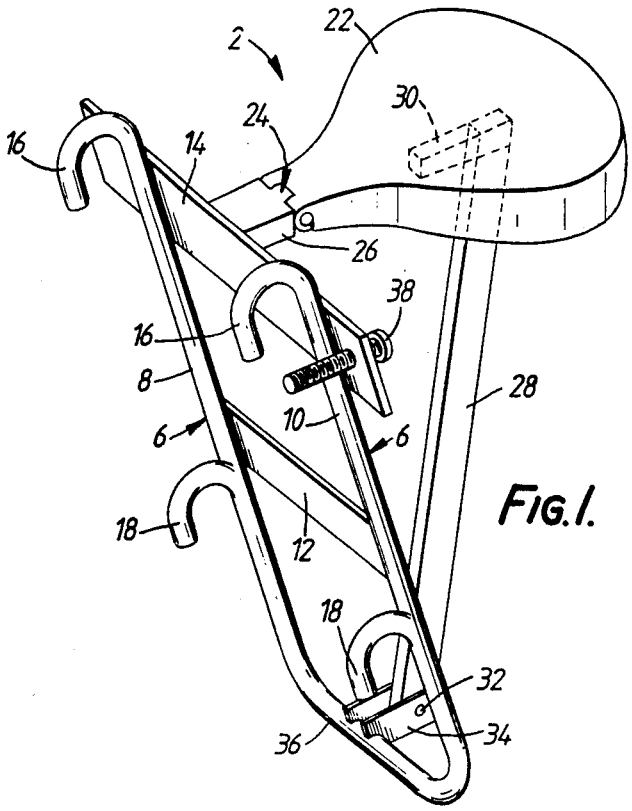
FIG. 1 is a perspective view of a first seat device.
Figure 2:
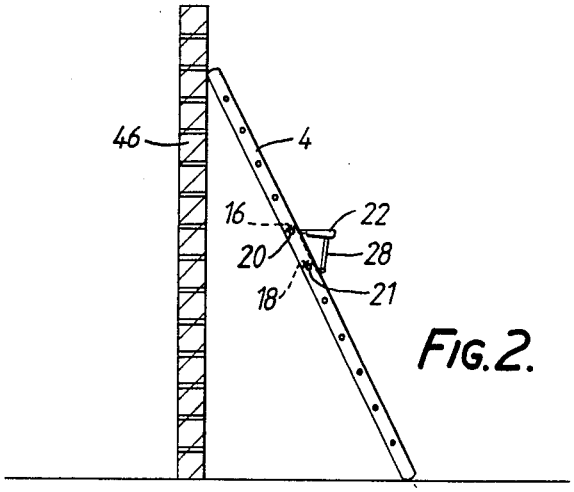
FIG. 2 illustrates the first seat device in position on a ladder.

Referring to FIGS. 1 and 2, there is shown a seat device 2 for a ladder 4. The seat device 2 comprises a frame 6 which has a pair of side members 8,10 and a pair of cross members 12,14.

Hook means in the form of two pairs of hooks 16,18 extend from the side members 8,10 of the frame. The hooks 16,18 are for fitting over two adjacent rungs 20,21 of the ladder 4.

The seat device 2 also comprises a seat 22 which extends from the side of the frame 6 opposite to the hooks 16,18. The seat 22 is for enabling a person to sit down whilst working on the ladder 4.

The seat 22 is foldable with respect to the frame 6. This is achieved by hinging the seat 22 by means of a hinge 24 to a frame extension piece 26, the frame extension piece 26 being secured to the cross member 14. The seat 22 is supported in its operative position by a support member in the form of a bar 28. The upper end of the bar 28 fits in a groove 30 formed in the underside of the seat 22. The lower end of the bar 28 is pivotally attached by means of a pivot 32 to a frame extension piece 34 which is secured to the rounded bottom part 36 of the frame 6.

The seat device 2 has releaseable locking means in the form of a bolt 38 which can be screwed underneath the rung 20 to provide an additional safety feature so that the seat device 2 cannot be knocked off the ladder 4 under any normal circumstances.

The seat device 2 may be made of any desired materials. The frame 6 will usually be made of an aluminium alloy whilst the seat 22 may be made of pressed steel, a plastics material or any other desired material. The various parts of the seat device 2 may be welded, rivetted, bolted or otherwise secured together.

Figure 3:
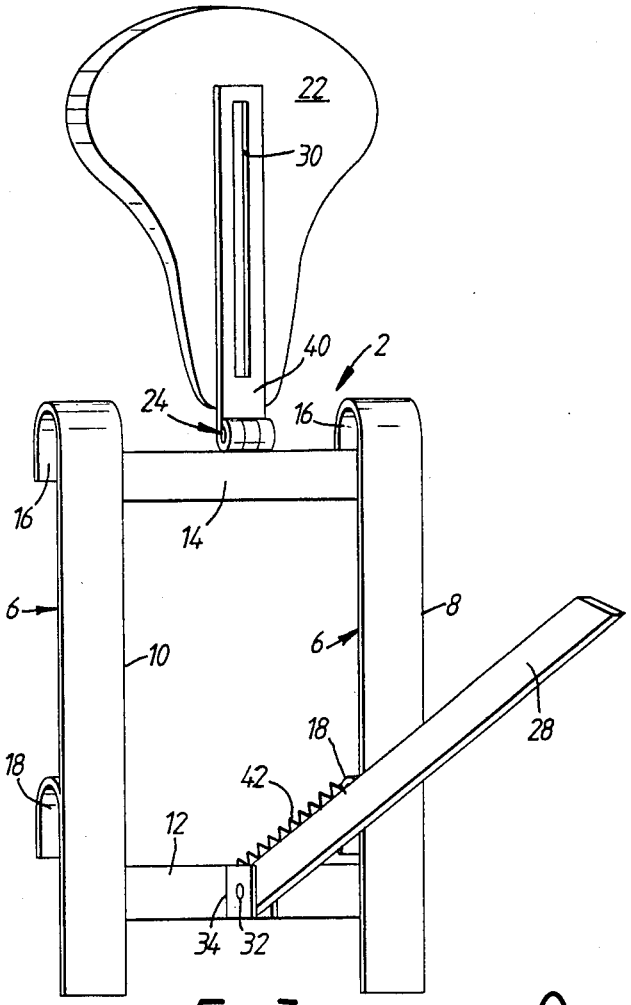
FIG. 3 is a rear view of a second seat device.

Referring now to FIG. 3, there is shown a slightly different design of seat device 2. For simplicity of illustration, similar parts as in FIGS. 1 and 2 have been given the same reference numbers and their precise construction and operation will not again be given. In FIG. 3, it will be seen that the groove 30 is formed in a bar 40. FIG. 3 also illustrates the use of restraining means in the form of a spring 42 for keeping the bar 28 in a fixed position adjacent the frame 6 when it is not in contact with the seat 22. When the bar 28 is adjacent the frame 6, then the seat 22 can be pivoted down over the top of the bar 28 to form a very compact package for carrying or storing.

Figure 4:
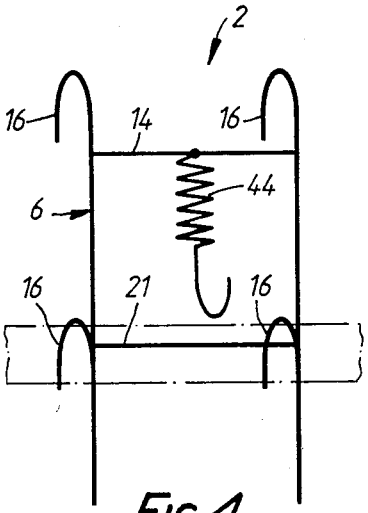
FIG. 4 illustrates schematically how a seat device may be provided with locking means.

Referring now to FIG. 4, there is shown somewhat schematically a seat device 2 which is provided with releaseable locking means in the form of a spring 44. The spring 44 is for releasably locking the seat device 2 to the ladder 4. The spring 44 hangs down from the cross member 14 and is able to hook under the rung 21 of the ladder 4.

It will be seen from FIG. 2, that when the seat 22 is horizontal, then the ladder 4 is at the correct angle of inclination against a wall 46. A person seated on the seat 22 can work with ease, comfort and safety.

Figure 5:
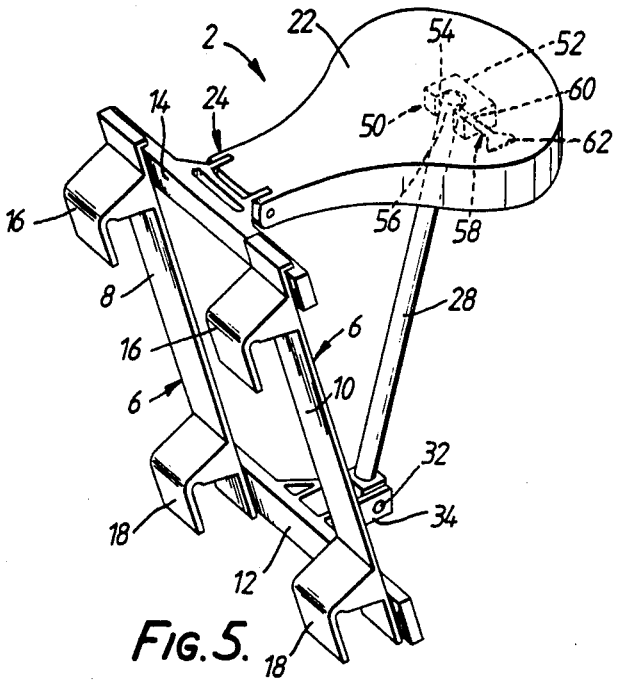
FIG. 5 is a perspective view of a third seat device.

Referring now to FIG. 5, similar parts as in FIG. 1 have been given the same reference numerals and their precise construction and operation will not again be given. In FIG. 5, it will be seen that the hooks 16,18 are of a relatively square shape for fitting over rungs of a ladder which are of square cross section. The side members 8,10 can be formed as separate extrusions or castings which can subsequently be secured to the cross members 12,14, for example by welding or screw threaded bolts.

The hooks 16,18 in FIG. 5 may be provided with rubber or plastics material inserts (not shown) for wedging on to ladder rungs which may be of a slightly different size and/or a slightly different shape to the hooks 16,18. The inserts thus take up any play and they are effective to stop any tendency of the seat device 2 from wobbling on the ladder 4.

Figure 6:
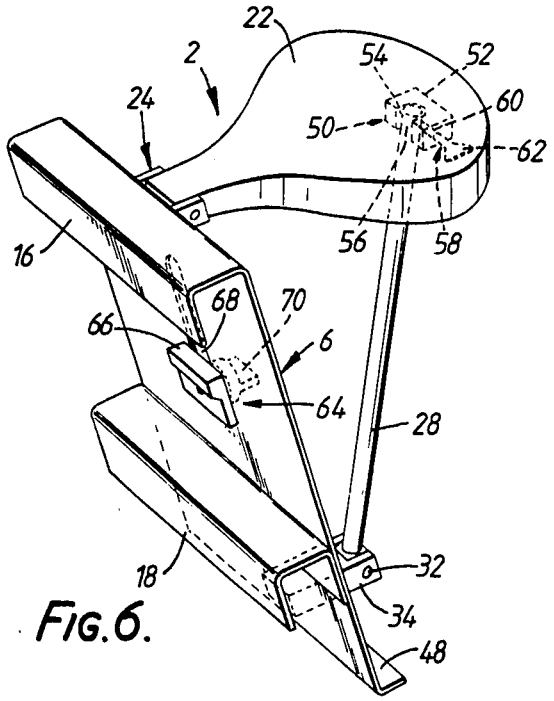
FIG. 6 is a perspective view of a fourth seat device.

In FIG. 5, it will be seen that the hook means comprises two pairs of hooks, one pair of hooks being the hooks 16 and the other pair of hooks being the hooks 18. Each separate pair of hooks 16 or 18 is for a separate rung of the ladder 4 as will immediately be appreciated. In FIG. 6, wherein similar parts have been given the same reference numbers, it will be seen that the hook means comprises two hooks 16,18 for clipping one over each of two separate rungs of the ladder 4. The hook 16 is formed as an integral part of the frame 6. Thus the frame 6 and the hook 16 can be formed as an integral extrusion or sheet material can be bent or otherwise formed to shape to form the frame 6 and the hook 16. The hook 18 is separately formed and subsequently secured to the frame 6, for example by welding or screw threaded bolts (not shown). The bottom part of the frame 6 is provided with a lip 48 to strengthen the bottom part of the frame 6.

Referring to FIGS. 5 and 6 together, both of the ladder devices 2 shown in FIGS. 5 and 6 are provided with releaseable locking means for releaseably locking the bar 28 to the seat 22. In general, the releaseable locking means should be such that if a person is ascending the ladder 4 and brushes against or otherwise strikes the seat 22 from underneath, the seat 22 should not part from the bar 28 and so causes the seat 22 unexpectedly to pivot downwardly about its hinge 24 and also the bar 28 to pivot outwardly about the pivot 32, since obviously the pivoting of the seat 22 and the bar 28 if unexpected could cause an accident. Thus, in FIGS. 5 and 6, the underside of the seat 22 is provided with a releaseable locking means 50 having a body part 52. The body part 52 is provided with a recessed portion 54 for receiving the top end 56 of the bar 28 as shown. A screw 58 screws through a threaded bore 60 in the body part 52 to engage the top end 56 of the bar 28 and thus releaseably locks the bar 28 in position. The screw 58 has a flat head 62 for enabling the screw 58 easily to be turned by hand.

The seat device 2 show in FIG. 6 is provided with releaseable locking means 64 for releaseably locking the seat device 2 to the ladder 4. More specifically, when the hook 16 shown in FIG. 6 has been located over a rung of the ladder 4, then a block 66 is slid upwardly along a slot 68 until the block 66 engages the lower surface of the rung of the ladder 4. A screw 70 is then tightened by hand to secure the block 66 in position and thus releaseably trap the rung of the ladder 4. Thus the entire seat device 2 is releaseably locked to the ladder 4.

Figure 7:
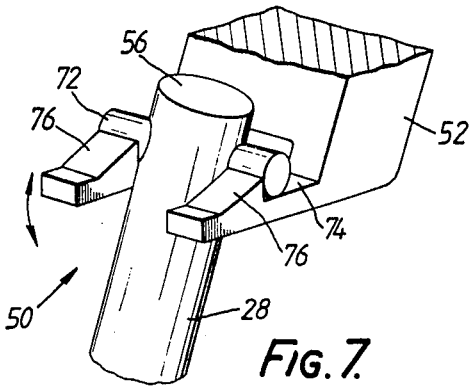
FIGS. 7, 8 and 9 show alternative seat locking devices to the seat locking device shown in FIGS. 5 and 6.

Referring now to FIG. 7, there is shown an alternative releaseable locking means 50 to that shown in FIGS. 5 and 6. In FIG. 7, the top end 56 of the bar 28 is provided with a pin 72. The pin 72 fits in a groove 74 formed in a body part 52 which may be secured to or formed integrally with the underside of the seat 22. The pin 72 can easily seat in the groove 74 by rolling up an inclined pair of surfaces 76 as shown. The pin 72, the groove 74 and the surfaces 76 can thus form a spring catch with the body part 52 being made of a plastics material if desired.

Figure 8:
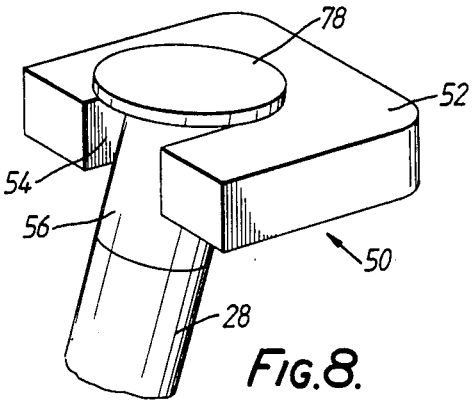

In FIG. 8, there is shown a further alternative releaseable locking means 50. In FIG. 8, the top end 56 of the bar 28 is provided with a mushroom head 78. The mushroom head 78 fits in the recessed portion 54 in the body part 52.

Figure 9:
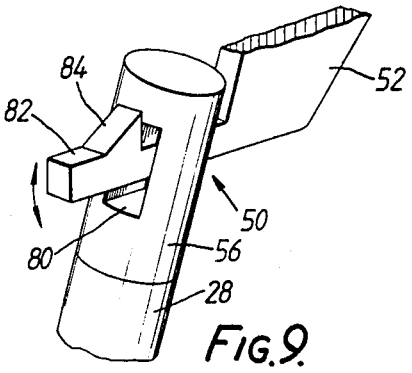

In FIG. 9, there is shown a yet further alternative releaseable locking means 50. In FIG. 9, the top end 56 of the bar 28 is provided with a slot 80. An arm 82 extending from the body part 52 extends through the slot 80 as shown. A ramp portion 84 on the arm 82 prevents the arm 82 from inadvertently being withdrawn from the slot 80. This is because, as shown, the ram portion 84 will abut against the top end 56 of the bar 28 if the seat 22 is inadvertently pushed upwardly by a person ascending the ladder 2. The arm 82 can only be removed from the slot 80 when the ramp portion 84 is correctly aligned with the slot 80.

It is to be appreciated that the embodiments of the invention described above have been given by way of example only and that modifications may be effected. Thus, for example, the seat device may be provided with tool receiving means such for example as a tray for receiving tools. The seat device can be made in any desired materials and, if desired, the entire seat device 2 can be made of plastics materials. Obviously, any plastics materials employed should be strong plastics materials and they may be reinforced as may be necessary. The frame 6 can be made of solid or box materials as may be desired. The bar 28 can be of any cross sectional shape so that it may be of square, round or other cross sectional shapes. The bar 28 may be extruded or cast. Where metals are employed, the preferred metal will be aluminium but other metals may be used.

The illustrated seats 2 are in the form of saddles, for example like the saddle of a bicycle or a tricycle. Such seats give good support for the back side of a person sitting on them and they do not cut into the inside of the person's legs. The seats 22 are smaller than the width of the ladder 4 since this also gives good comfort to a person seated on the seats 22. The seats 22 may be sprung if desired. Alternative types of seats such for example as a padded bar may be employed if desired.

Where the seats are foldable, then releaseable locking means may be employed for maintaining the seats in their folded non-operative position. Such releaseable locking means may be a rubber strap and a clip. The rubber strap may have a lifting tag in order to enable it easily to be fixed and unfixed in position. Various types of releaseable locking means for securing the seats in their folded position may be employed.

The seat device 2 may be sold under the trade name THE EASY SEAT.

I claim:

1. A seat device for a ladder, which seat device comprises a frame, first hook means extending from the frame and for fitting over a first rung of the ladder, second hook means extending from the frame and for fitting over a second and adjacent rung of the ladder, a seat which extends from the frame and which is foldable upwardly with respect to the frame, a support member having a first end portion which is remote from the seat and which is permanently pivotally mounted to the frame and a second end portion which is operatively connectible to the seat for the purpose of enabling the support member to support the seat and which is separable from the seat for the purpose of allowing the seat to be folded, and releaseable locking means between said seat and said second end portion for maintaining the seat in its unfolded position so that the seat cannot collapse to its folded position as a result of being pushed upwardly as a person is climbing the ladder.

2. A seat device according to claim 1 in which the hook means comprises two pairs of hooks for clipping over two rungs of the ladder, with one pair of the hooks being for each rung.

3. A seat device according to claim 1 in which the hook means comprises two hooks for clipping one over each of two separate rungs of the ladder.

4. A seat device according to claim 1 and including releaseable locking means for releaseably locking the seat device to the ladder.

* * * * *